United States Patent [19]

Karaba et al.

[11] 4,016,841

[45] Apr. 12, 1977

[54] VARIABLE COMPRESSION RATIO PISTON

[75] Inventors: Albert M. Karaba, Muskegon; Alexander P. Brouwers, Bloomfield Hills; Thomas J. Pearsall, Grand Haven, all of Mich.

[73] Assignee: Teledyne Industries, Inc., Los Angeles, Calif.

[22] Filed: Sept. 10, 1975

[21] Appl. No.: 611,863

[52] U.S. Cl. ..... 123/78 B; 123/48 R; 123/78 AA

[51] Int. Cl.[2] ..... F02B 75/04

[58] Field of Search ..... 92/60.5; 123/48 R, 48 B, 123/78 R, 78 AA, 78 B

[56] References Cited

UNITED STATES PATENTS

| | | | |
|---|---|---|---|
| 1,825,163 | 9/1931 | Schweter | 123/78 B |
| 2,742,027 | 4/1956 | Mansfield | 123/78 B |
| 3,161,112 | 12/1964 | Wallace | 123/48 B |
| 3,311,096 | 3/1967 | Bachle et al. | 123/78 B |
| 3,358,657 | 12/1967 | Hermann | 123/78 B |
| 3,450,112 | 6/1969 | Bachle | 123/78 B |
| 3,656,412 | 4/1972 | Wilson | 123/48 B |
| 3,667,433 | 6/1972 | Isley | 123/78 B |
| 3,704,695 | 12/1972 | Cronstedt | 123/78 B |

*Primary Examiner*—Wendell E. Burns
*Assistant Examiner*—David D. Reynolds
*Attorney, Agent, or Firm*—Gifford, Chandler, Sheridan & Sprinkle

[57] ABSTRACT

A two part variable compression ratio (VCR) piston assembly having an outer member movable relative to an inner member to vary the compression ratio of an internal combustion engine and a hydraulic system utilizing oil from the lubrication system of the engine for automatically controlling the relative movement of the members to maintain a predetermined maximum combustion chamber pressure. A hydraulic circuit includes an upper and a lower chamber which expands and contracts conversely upon relative movement of the piston members and a system for supplying oil to the upper chamber and to the lower chamber via the upper chamber and for discharging the oil from the upper chamber in a manner which gradually changes the compression ratio of the piston until a predetermined maximum combustion chamber pressure has been achieved and which tends to maintain the maximum combustion chamber pressure after it has been achieved. The lower chamber is disposed adjacent the piston ring area of the piston assembly and the hydraulic system includes an uniquely formed pressure responsive relief valve to discharge oil from the upper chamber to the crankcase of the engine upon a predetermined pressure being produced in that chamber.

15 Claims, 4 Drawing Figures

VARIABLE COMPRESSION RATIO PISTON

BACKGROUND OF THE INVENTION

1. Field of the Invention

The present invention relates to variable compression ratio (VRC) piston assemblies such as those disclosed in U.S. Pat. Nos. 3,156,162; 3,161,112; 3,185,137; 3,185,138; 3,303,831; 3,311,096; 3,402,662; 3,418,982; 3,450,111; 3,417,738; 3,417,739; 3,450,112; 3,527,265; 3,405,698; 3,405,697; 3,405,113; 3,407,791; 3,667,433; and 3,704,695; all owned by applicants' assignee and more particularly to an improved construction for such piston assemblies.

2. Description of the Prior Art

In the constructions disclosed in the patents indicated above an inner piston member is connected in the usual manner to a connecting rod and an outer piston member is carried by and is movable axially relative to the inner member. Relative movement of these members varies the compression ratio of the particular cylinder in which the piston moves. Clearance spaces are provided between the top and bottom ends of the inner and outer members and these form upper and lower chambers which vary conversely in volume in relation to the relative movement of the members. An incompressible fluid such as lubrication oil is supplied to these chambers in a manner which automatically regulates movement of the members to gradually change the compression ratio until a predetermined combustion pressure has been achieved. The hydraulic system then varies the movement of the members in a manner which tends to maintain a uniform maximum combustion chamber pressure.

In the type of assembly disclosed in these patents, inertia, oil pressure, and cylinder pressure are depended upon to provide the force for relative movement between the members and the hydraulic system is utilized to regulate the relative movement in response to changes in the fluid pressures. Inertia forces increase proportional to the square of engine speed and thus at high speeds operation of the pressure relief valve may be affected due to inertial effects on the valve parts so that it will take a greater pressure to open valves of conventional construction at high engine speeds than it will at lower engine speeds. For this reason a number of previous attempts have been made to provide such valves designed to minimize the effects of inertia upon their proper operation.

Further, in previous assemblies the lower chamber has been located in the lower skirt area of the piston necessitating substantial structure between the upper and lower chamber.

The upper chamber commonly communicates with a chamber disposed adjacent the ring area of the piston to provide cooling in this area.

Also the hydraulic systems of previous VCR assemblies have generally included a collector or supply valve assembly which directs the oil by separate passages to the upper chamber and to the lower chamber.

SUMMARY OF THE INVENTION

The present invention provides a lightweight, inexpensive VCR piston constructed to minimize the effects of inertia on the discharge valve and to provide rapid response to variations in engine load.

The VRC piston of the present invention comprises an outer member and an inner member. A plate is attached to the top of the inner member and forms a supply valve passage, a discharge valve passage and the lower boundary of the upper chamber. Oil is supplied to the supply valve passage and through a supply valve carried therein directly to the upper chamber.

The discharge valve is carried within the discharge valve passage formed in the plate and comprises a tapered washer which deflects with pressure to snap from a closed position to an open position. The discharge valve opens the upper chamber to the crankcase of the engine and thus regulates oil pressure in the upper chamber. The valve will open at a pre-set oil pressure permitting the volume of the upper chamber to decrease and thus reduce the gas pressure in the combustion chamber.

A lower oil chamber is formed in the ring groove area of the piston by the plate, the inner member and a retaining ring mounted to the lower inside surface of the outer member. The lower chamber receives oil directly from the upper chamber through a passage formed in the plate. The oil pressure in the lower chamber offsets the inertia force on the outer member and the passage between the chambers is of a sufficiently small cross section to limit excessive piston travel per stroke which could result in cavitation erosion and unstable operations.

DESCRIPTION OF THE DRAWINGS

A better understanding of the present invention will be achieved upon reference to the following description which refers to the accompanying drawings in which like reference numerals refer to like parts throughout the several views and in which.

DESCRIPTION OF A PREFERRED EMBODIMENT

Figure 1:
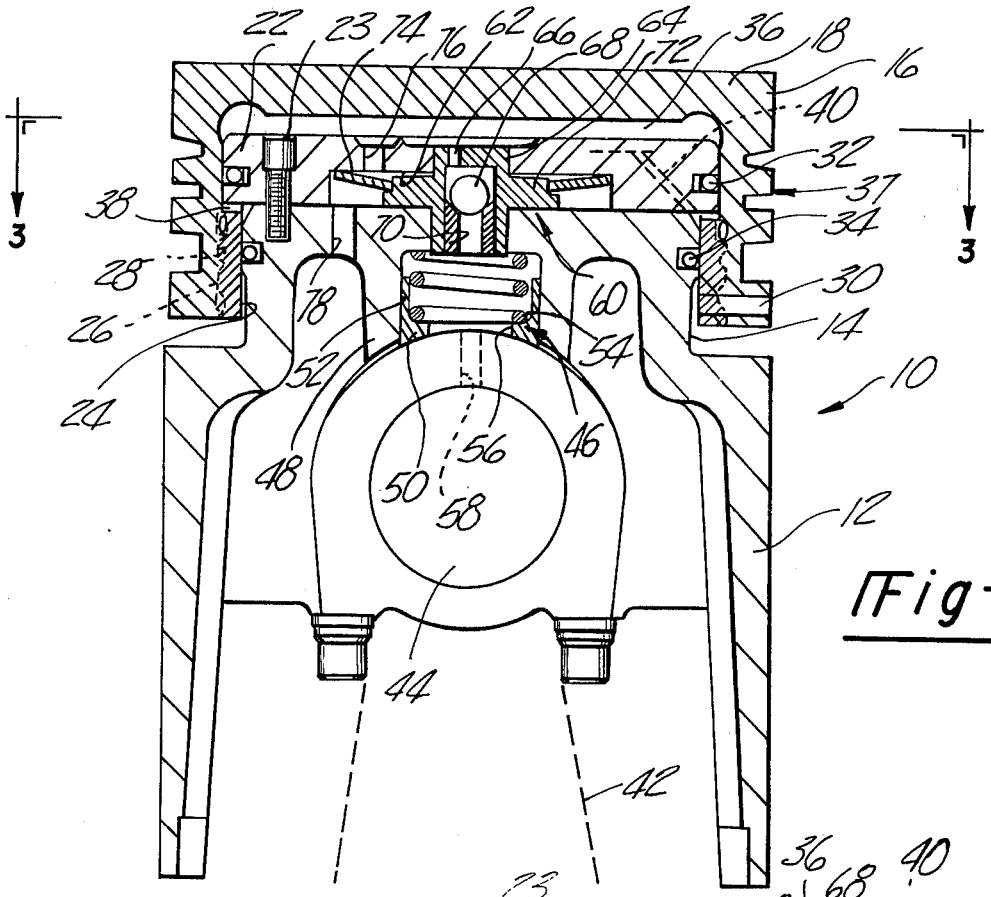
FIG. 1 is a longitudinal cross-sectional view of a piston assembly embodying a preferred construction of the present invention and illustrating the assembly in one operational position.

Now referring to the drawings for a more detailed description of the present invention a preferred variable compression ratio (VCR) piston 10 is illustrated as comprising an inner member 12 having a radially reduced upper section 14. An outer member 16 is mounted to the outer surface of the reduced section 14.

The outer member 16 has a crown 18 which serves as the head of the piston 10 and which forms a movable wall of the lower boundary of the combustion chamber of the engine. The outer member 16 is axially slidably mounted to the outer surface of the section 14 of the inner member 12.

Figure 3:
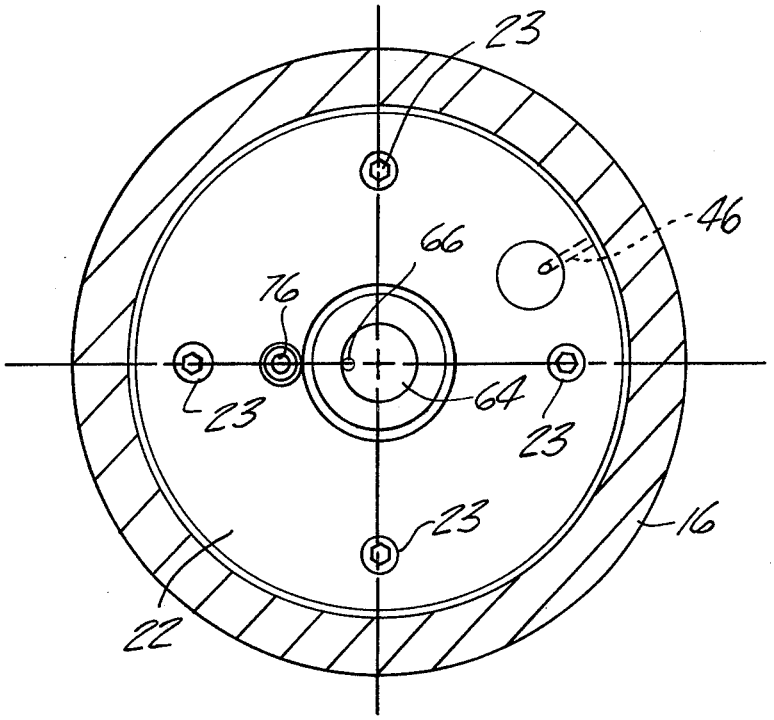
FIG. 3 is a cross sectional view as seen substantially from line 3—3 of FIG. 1.
Figure 4:
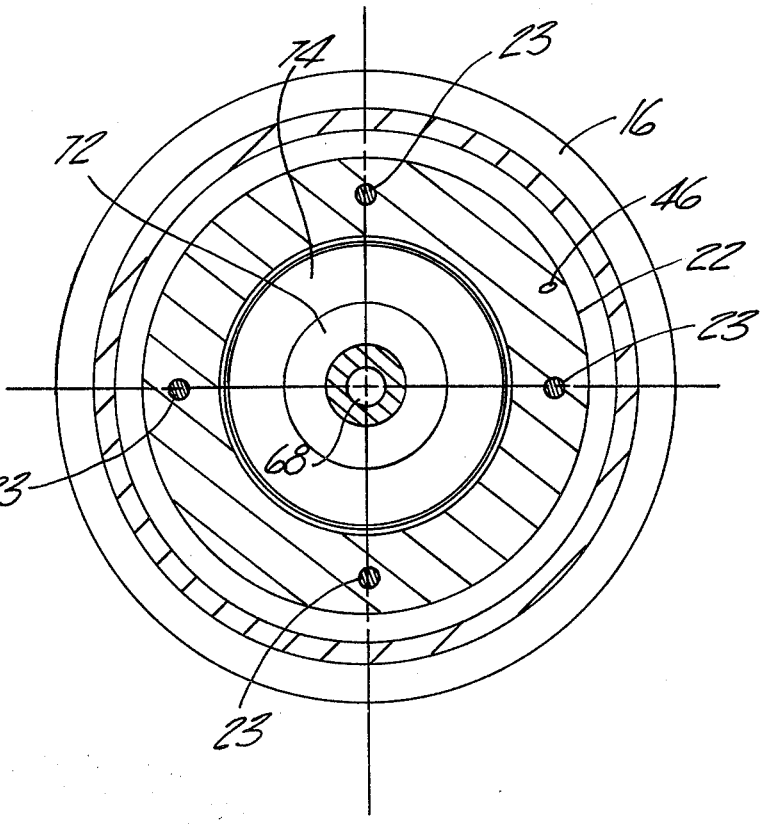
FIG. 4 is a cross sectional view as seen substantially from line 4—4 of FIG. 2.

A plate 22 is mounted to the top of the inner member 12 preferably by bolts 23 (FIG. 3) and a ring 24 having external threads 26 is mounted to the outer member 16 by threads 28 found on the inside surface of the lower portion of the outer member 16, the threaded joint 24 and 16 being only one preferred method of attachment. A lock means, such as a lock pin 30 holds the ring 24 in position. A seal 32 carried by the plate 22 and a seal 34 carried by the reduced section 14 of the inner member 12 engages the ring 24 to provide a fluid seal between the members in the area of their sliding contact.

An upper chamber 36 is formed between the plate 22 and the inside surface of the crown 18 and a lower annular chamber 38 is formed between the lower edge of the plate 22, the outer member 16 and the ring 24 closely adjacent the ring groove area 37 of the piston 10. A sealing ring 34 is provided to prevent oil leakage from the lower chamber except through passage 40. An unrestricted passage 40 formed through the plate 22 connects the upper chamber 36 and the lower chamber 38.

The inner member 12 is connected to a connecting rod 42 by a piston pin 44 in the conventional manner of connecting engine pistons to a connecting rod. An oil collector assembly generally indicated at 46 is carried in a portion 48 of the inner member 12 extending downwardly into engagement with the top of the connecting rod 42. The collector assembly 46 preferably comprises an internally cored cap member 50 slidably carried in a recess 52 formed in the inner piston 12 and having a lower edge formed to conform to the upper surface of the connecting rod 42 so that as the connecting rod 42 pivots on the pin 44 and with respect to the inner member 12 the lower surface of the cap member 50 can conform tightly to the upper surface of the connecting rod 42. A spring 54 carried in the recess 52 urges the cap member 50 outwardly into engagement with the connecting rod 42.

The cap member 50 is provided with a central opening 56 which registers with an outlet passage 58 formed in the connecting rod 42. The passage 58 is connected with the lubrication system of the engine by means not shown.

A valve assembly 60 is carried in a chamber 62 formed in the plate 22 and includes a central substantially tubular portion 64 having a lower end extending through the upper portion of the inner member 12 to register with the recess 52. An upper end extends through the plate 22 and has a passage 66 opening to the upper chamber 36. A ball 68 is carried within the tubular portion 64 and is normally positioned on a seat 70 to block fluid flow through the tubular portion 64 to the passage 66 but is movable under pressure and inertia to a position opening such fluid flow.

A radially extending central portion 72 of the valve assembly 60 provides the means for carrying a tapered washer or Belleville spring type discharge valve 74 which in its closed position blocks flow from a passage 76 connected through the plate 22 to the upper chamber 36, to a passage 78 connected through the inner member 12 to the crankcase (not shown) of the engine.

As the invention has thus far been described it is apparent that the inner member 12 being connected to the connecting rod 42 in the conventional manner moves up and down within the cylinder of an internal combustion engine within fixed limits and in the manner of a conventional piston. The outer member 16 reciprocates within the cylinder within the axial limits defined at its lower limit by the crown 18 engaging the top of the plate 22 and at its upper limit by the top of the ring 34 engaging the lower edge of the plate 22. Thus as the piston 10 reciprocates, the outer member 16 will tend to move under the influence of inertia toward the extreme uppermost and the extreme lowermost positions. The lubricant supplied to the chambers 36 and 38 however regulates this movement in a manner to provide an increased compression ratio for the engine while at the same time maintaining a predetermined maximum combustion chamber pressure which is established by the opening pressure setting of valve 74.

This is accomplished by the inertia and oil pressure acting on the outer member 16 at the upper end of the exhaust stroke and the early part of the downward intake stroke causing the outer member 16 to separate from the inner member 12. As the members separate the upper chamber 36 expands and the ball 68, which acts as a one way inlet valve, moves to a position to permit oil to be directed to the expanding chamber 36 from the passage 66. The ball 68 prevents the oil from passing back into the supply valve assembly 60 from the upper chamber 36 on the downward stroke of the piston.

Figure 2:
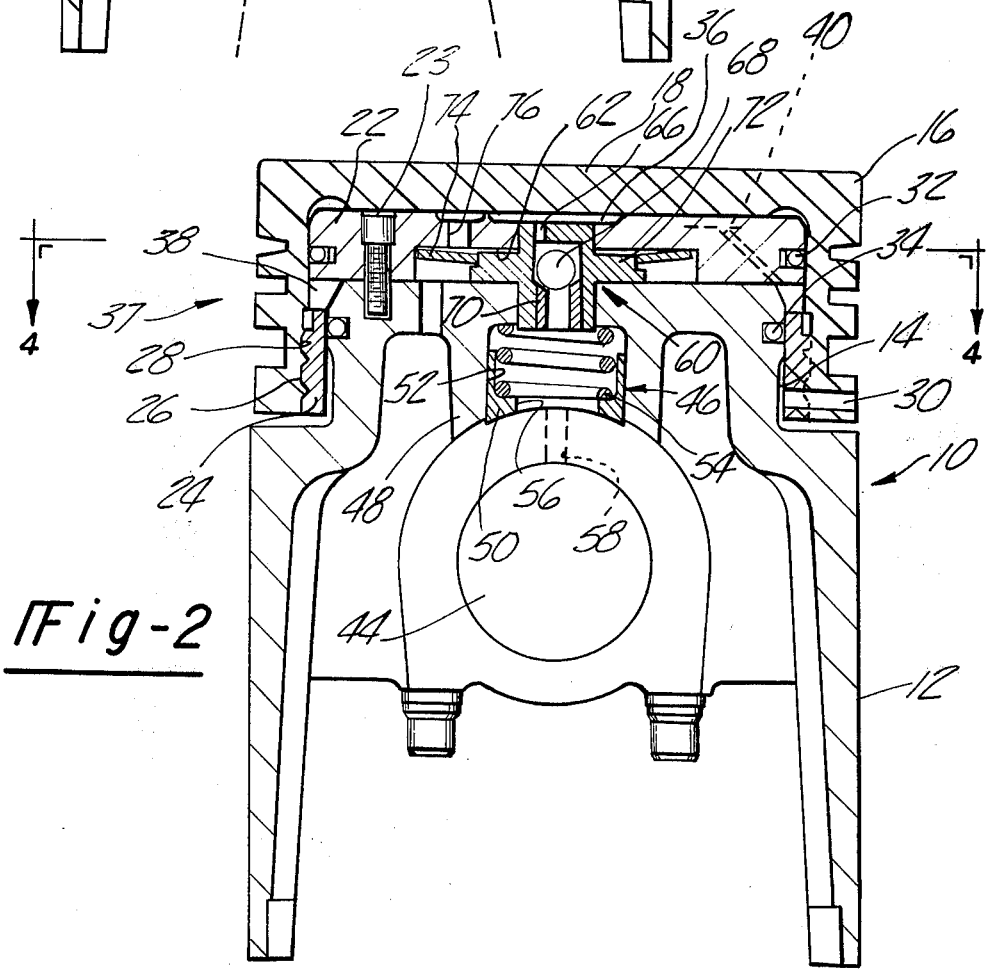
FIG. 2 is a view similar to FIG. 1 but illustrating the assembly in another operational position.

FIG. 1 illustrates the piston assembly 10 in the extended or high compression position. In this position the chamber 36 is filled with oil. FIG. 2 illustrates the piston 10 in the low compression position when the engine has just been started or the valve 74 has just dumped the oil from the upper chamber 36.

The upper chamber 36 is connected directly to the lower chamber 38 by the passage 40. There is no valve in the passage 40 so that oil can flow back and forth between the chambers 36 and 38. A restricted orifice, shown as passage 40, however, limits the rate of flow from lower chamber 38 to upper chamber 36. The oil in the lower chamber 38 offsets the inertia force on the outer member 16 and by reason of the restricted connection between the chambers 36 and 38, limits excessive piston travel per stroke.

This is a substantial departure from the previous methods employed for regulating the extension of VRC piston assemblies. In such previous constructions the oil from the connecting rod is supplied to both the upper and the lower chamber and is discharged from the lower chamber through a restricted orifice.

The separation of the inner member 12 and the outer member 16 is increased in small increments during each cycle of operation of the engine until a predetermined combustion chamber pressure has been achieved. When this happens the pressure increase in the combustion chamber is transmitted through the crown 18 to the oil within the chamber 36 to act upon the valve 74 and deflect it downwardly to thereby open a passage to permit the chamber 36 to contract and the members 12 and 16 to come closer together.

The tapered spring, discharge valve 74 utilized in the present invention provides faster dumping than heretofore achieved. It also permits the height of the valve assembly 60 and thus of the piston 10 to be substantially reduced thereby saving material costs. Also because it has a high area to weight ratio it permits more precise control and it is less sensitive to inertia and the effects of engine speed than previous VCR piston designs.

The particular construction provides an assembly in which the length of the outer member 16 has been substantially shortened over previous constructions. This substantially reduces the weight and the cost. Further, it results in the lower chamber 38 being in close proximity to the ring groove area 37 of the piston so that the oil contained in the chamber 38 can perform a cooling function.

It is also apparent that although we have described but one embodiment of our invention many changes and modifications can be made therein without departing from the spirit of the invention as expressed by the scope of the appended claims:

We claim:

1. In an internal combustion engine, a piston having an inner and an outer member telescopically received by said inner member, said members being movable in response to reciprocation of the piston with respect to a combustion chamber of the engine, a first fluid chamber and a second fluid chamber varying in volume in response to said relative movement and to variations in the quantity of fluid therein, means supplying fluid to said chambers, said means comprising a first passage in said piston connecting with said first fluid chamber, a one way inlet valve disposed in said first passage and a second unrestricted passage in said piston directly connecting said first chamber with said second chamber said second passage being the only means of communication between said first chamber and said second chamber.

2. The invention as defined in claim 1 in which said outer member terminates substantially short of the end of said inner member.

3. The invention as defined in claim 1 and in which said inner member has a reduced diameter section near the upper end thereof, and said outer member being disposed only around said reduced diameter section.

4. The invention as defined in claim 1 and in which said outer member is provided with a ring groove area and said second chamber is disposed adjacent said ring groove area.

5. The invention as defined in claim 3 and in which said first chamber is formed intermediate the upper end of said inner member and the upper end of said outer member, and said second chamber is formed adjacent the reduced diameter portion of said inner member.

6. The invention as defined in claim 1 and including a third passage connected with said first chamber and communicating with the crankcase of said engine, a normally closed valve disposed within said third passage and operable upon a predetermined pressure in said first chamber to open and thereby permit fluid to discharge from said first chamber.

7. The invention as defined in claim 6 and in which said valve is a tapered washer.

8. The invention as defined in claim 6 and in which said valve is a Belleville washer.

9. The invention as defined in claim 1 and including a plate carried at the upper end of said inner member, said fluid supplying means including valve means carried by said plate.

10. In an internal combustion engine having a crankcase, a piston having first and second members movable relative to one another in response to reciprocation of the piston with respect to a combustion chamber of the engine, and having a pressure fluid chamber within said piston which varies in internal volume in response to said relative movement and to variations in the quantity of fluid therein, means for supplying fluid to said chamber, the combination therewith of means in one of said members forming a discharge passageway connecting said chamber with said crankcase, normally closed valve means disposed in said passageway and operable to open a predetermined pressure of the fluid in said chamber to thereby permit discharge of some of said fluid from said chamber to said crankcase, said valve means including a tapered washer normally having its radial edge in a position closing fluid flow through said passageway and being operable upon a predetermined pressure being exerted on said washer to deflect from said closed position to a position opening fluid flow around said radial edge.

11. The invention as defined in claim 10 and in which said first member is telescopically received by said second member and said chamber is formed intermediate said first and second members, said passageway being formed in said second member, said first member and said second member each having a lower edge, the lower edge of said first member being spaced a substantial axial distance from the lower edge of said second member.

12. The invention as defined in claim 10 and including a second chamber which varies in internal volume in reverse proportion to the variance of said first chamber, an unrestricted passageway formed in said second member connecting said first mentioned chamber and said second chamber, said passageway being the only connection between said first mentioned chamber and said second chamber.

13. The invention as defined in claim 10 and including an inlet valve assembly carried in said second member, said assembly including a tubular portion extending through said second member and connecting with said chamber, said tapered washer being disposed around the outer periphery of said tubular member.

14. The invention as defined in claim 13 and in which said second member includes a plate mounted to the top thereof, said plate mounting said inlet valve assembly and said tapered washer in place in said second member.

15. In an internal combustion engine, a piston having an inner and an outer member telescopically received by said inner member, said members being movable with respect to each other in response to reciprocation of the piston with respect to a combustion chamber of the engine, a first fluid chamber and a second fluid chamber disposed intermediate said members, said chambers expanding and contracting in inverse proportion to each other upon relative movement of said inner and said outer member, means supplying fluid to said first chamber and from said first chamber to said second chamber, said outer member having a ring groove area and a lower end closely adjacent said ring groove area, said inner member having a lower end, the lower end of said outer member being spaced a substantial axial distance from the lower end of said inner member, and said second fluid chamber being formed intermediate said outer member and said inner member in an area closely adjacent said lower end of said outer member and also the ring groove area of said outer member.

* * * * *

UNITED STATES PATENT AND TRADEMARK OFFICE

CERTIFICATE OF CORRECTION

PATENT NO. : 4,016,841
DATED : April 12, 1977
INVENTOR(S) : Albert M. Karaba et al.

It is certified that error appears in the above-identified patent and that said Letters Patent are hereby corrected as shown below:

Col. 2, line 1, delete "VRC" and insert --VCR--

Col. 4, line 34, delete "VRC" and insert --VCR--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 4,016,841

DATED : April 12, 1977

INVENTOR(S) : Albert M. Karaba, Alexander P. Brouwers, & Thomas J. Pearsall

It is certified that error appears in the above-identified patent and that said Letters Patent are hereby corrected as shown below:

Column 6, line 5, after "open", insert --upon--.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*